US009249587B2

(12) United States Patent
Hunt

(10) Patent No.: US 9,249,587 B2
(45) Date of Patent: Feb. 2, 2016

(54) COLLAPSIBLE CARDBOARD CONCRETE FORM

(71) Applicant: Marty Hunt, Ocoee, FL (US)

(72) Inventor: Marty Hunt, Ocoee, FL (US)

( * ) Notice: Subject to any disclaimer, the term of this patent is extended or adjusted under 35 U.S.C. 154(b) by 0 days.

(21) Appl. No.: 14/133,731

(22) Filed: Dec. 19, 2013

(65) Prior Publication Data

US 2014/0166848 A1 Jun. 19, 2014

Related U.S. Application Data

(60) Provisional application No. 61/739,043, filed on Dec. 19, 2012.

(51) Int. Cl.
*E04G 9/08* (2006.01)
*E04G 9/10* (2006.01)
*E04G 13/02* (2006.01)

(52) U.S. Cl.
CPC *E04G 9/083* (2013.01); *E04G 9/10* (2013.01); *E04G 13/02* (2013.01)

(58) Field of Classification Search
CPC ..... E04G 9/08; E04G 9/083; E04G 13/00; E04G 13/02
USPC ..... 249/2, 3, 4, 5, 6, 7, 134, 160, 170; 264/31; 52/741.1, 741.15
See application file for complete search history.

(56) References Cited

U.S. PATENT DOCUMENTS 1,635,093 A * 7/1927 McPherson et al. ..... 264/256
2,101,019 A 12/1937 Bowes
3,024,512 A * 3/1962 Dyer ..... 249/51
3,357,673 A * 12/1967 Williams ..... 249/194
3,385,552 A * 5/1968 Von Drasek et al. ..... 249/4
3,829,057 A 8/1974 Fuchs
3,917,216 A * 11/1975 Plough ..... 249/48
4,023,766 A 5/1977 Lubov
4,055,321 A * 10/1977 Schimmel ..... 249/182
4,563,381 A * 1/1986 Woodland ..... 428/156
4,644,858 A * 2/1987 Liotto et al. ..... 99/449
4,776,555 A * 10/1988 Maynard ..... 249/6
5,039,058 A * 8/1991 Boeshart ..... 249/194
5,090,884 A * 2/1992 Beaman ..... 425/63
5,562,272 A * 10/1996 McAbee et al. ..... 249/2
5,599,491 A * 2/1997 Pollock et al. ..... 264/138
5,788,874 A * 8/1998 Tucker, Jr. ..... 249/180
2002/0047083 A1* 4/2002 Austin ..... 249/207
2007/0194205 A1* 8/2007 Blackmon ..... 249/185
2012/0297701 A1 11/2012 Oakley

* cited by examiner

*Primary Examiner* — Michael Safavi
(74) *Attorney, Agent, or Firm* — Matthew G. McKinney, Esq.; Allen, Dyer, Doppelt, Milbrath & Gilchrist, P.A.

(57) ABSTRACT

A collapsible cardboard concrete form is disclosed. In a particular embodiment the form includes a cardboard box beam having a depressed longitudinal section along an outer portion of its length for added structural integrity. A lateral notch is disposed in the outer portion of the form at intervals and across a width of the form to divide the form into what will be the sides of the form when assembled. The lateral notches include a flexible planar connector of an inner portion of the form to allow the notch to act as a hinge and bend to create each corner of the form. A tab extends from one end of the form and is used to tuck in an opposing end of the form. The surfaces of the form may be coated with wax, or other sealant, to prevent moisture damage to the form as the concrete is curing.

16 Claims, 4 Drawing Sheets

FIG. 3
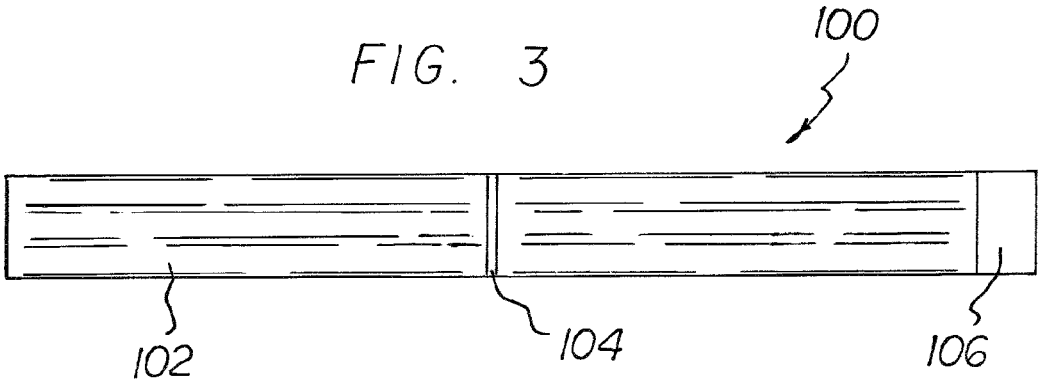
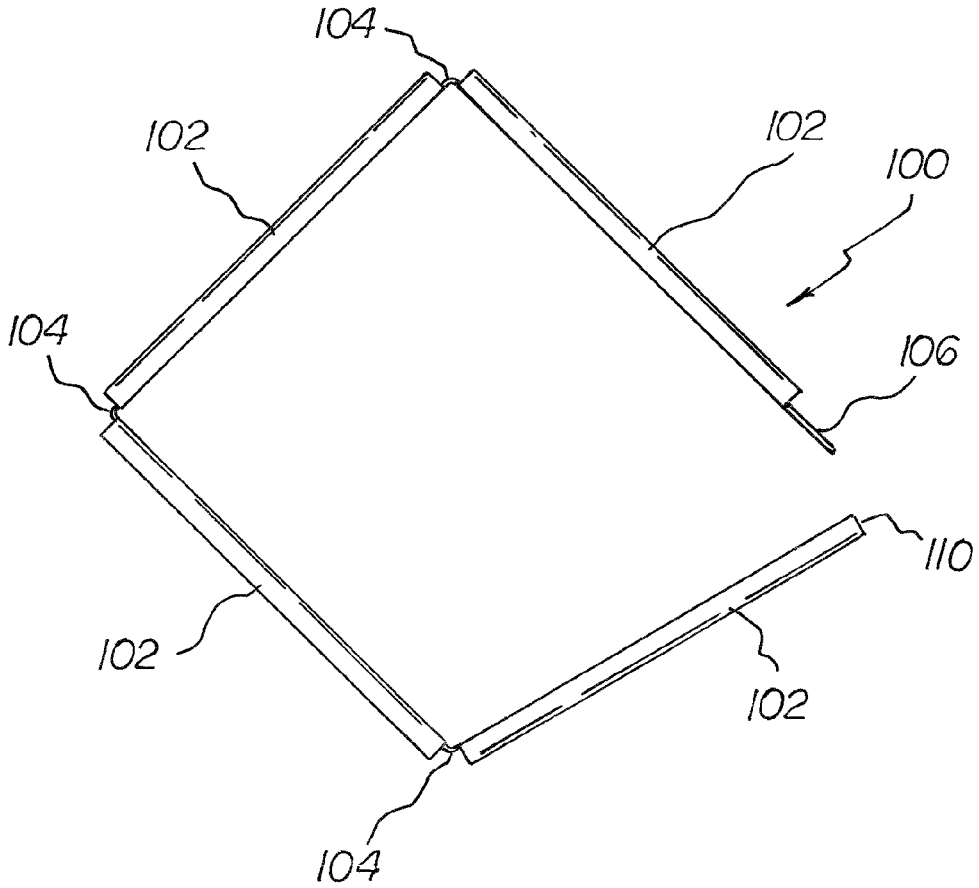
FIG. 4

FIG. 5
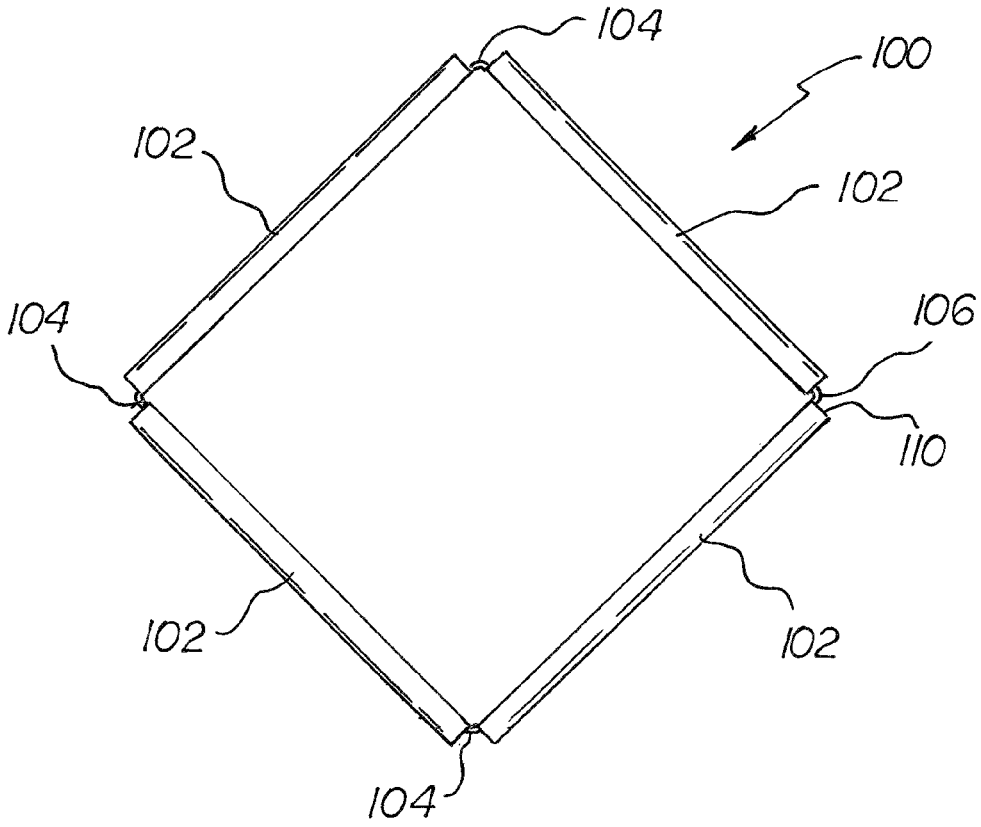
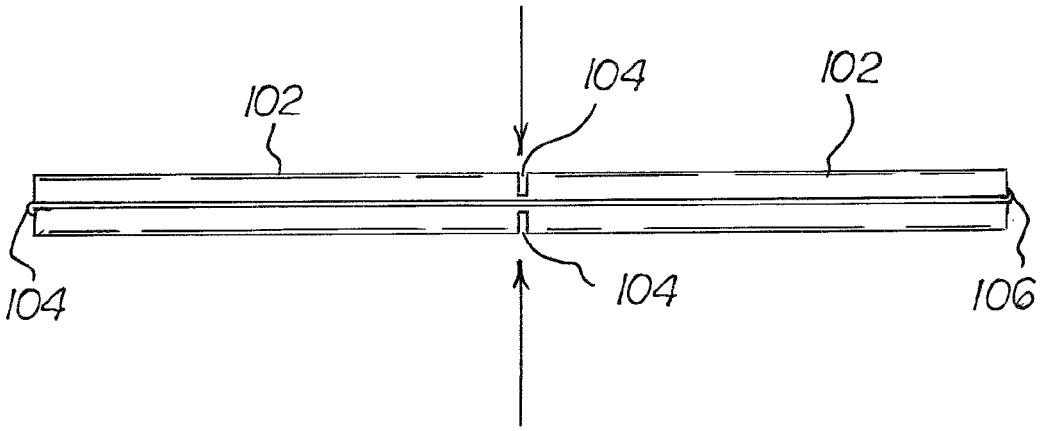
FIG. 6

FIG. 7
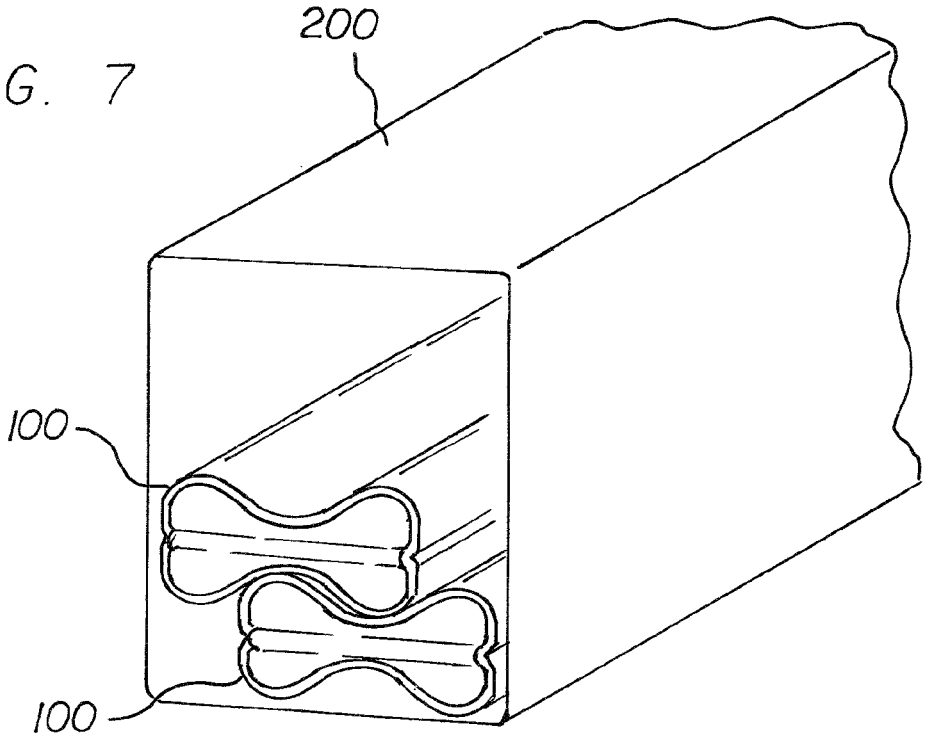
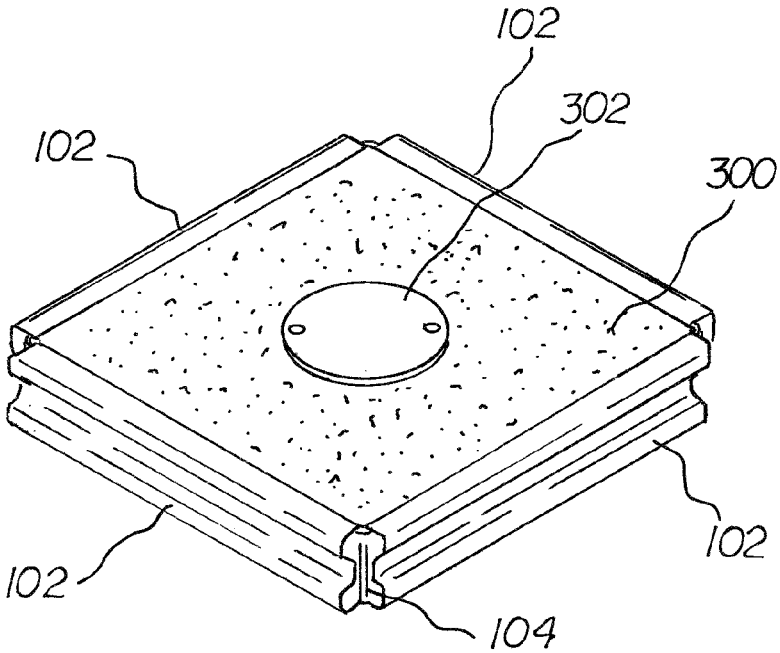
FIG. 8

COLLAPSIBLE CARDBOARD CONCRETE FORM

I. CROSS REFERENCE TO RELATED APPLICATIONS

This application claims the benefit of U.S. Provisional Application No. 61/739,043 filed Dec. 19, 2012. The disclosure of the provisional application is incorporated herein by reference.

II. FIELD

The present disclosure is generally related to a collapsible cardboard concrete form.

III. DESCRIPTION OF RELATED ART

Concrete forms are used to define a perimeter of an area to be poured with concrete. The forms are required to support and shape the poured concrete until the concrete has cured. Currently, concrete forms are most often constructed using wood boards, which are relatively expensive. The boards may be heavy and difficult to work with for those without sufficient carpentry skills. The boards are typically installed by nailing the boards to stakes driven in the ground. After the concrete has been poured and cured, the boards are removed. The boards may be discarded or reused. However, each time the boards are reused they are required to be reconditioned. In addition, transportation of prefabricated or factory made forms is relatively expensive and difficult due to the fact that heavy materials are necessary to withstand the rough handling in use and reuse. Accordingly, forms or materials designed to create shapes and voids in poured concrete structures are typically constructed of relatively heavy and cumbersome materials to fulfill their function and withstand the rough handling.

Accordingly, what is needed in the art is a concrete form that is inexpensive, lightweight, and efficient to ship and store, easy to install, and that does not need to be removed after the concrete has cured. However, in view of the prior art at the time the present invention was made, it was not obvious to those of ordinary skill in the pertinent art how the identified needs could be fulfilled.

IV. SUMMARY

In a particular embodiment, a collapsible cardboard concrete form is disclosed. The form includes a cardboard box beam having a depressed longitudinal section along an outer portion of its length for added structural integrity. A lateral notch is disposed in the outer portion of the form at intervals and across a width of the form to divide the form into what will be the sides of the form when assembled. The lateral notches include a flexible planar connector of an inner portion of the form to allow the notch to act as a hinge and bend to create each corner of the form. A tab extends from one end of the form and is used to tuck in an opposing end of the form when assembling. The sides of the form are adapted to be collapsible and folded flat back over the other sides of the form. In use, the form is moved from the collapsed position to an open position to create a shape that will hold concrete within its sides. The form is placed on the ground and readied for concrete. The concrete is poured within the boundary of the form and allowed to cure. The form is adapted to decompose in place so that the user is not required to come back and remove the form at a later date. The surfaces of the form may be coated with wax, or other sealant, to prevent moisture damage to the form as the concrete is curing. In addition, an expandable cover may be secured to an exterior surface of the box beam, where the expandable cover is configured to span across an interior opening created by the box beam in the assembled position to cover the concrete within the form.

Other aspects, advantages, and features of the present disclosure will become apparent after review of the entire application, including the following sections: Brief Description of the Drawings, and Detailed Description.

V. BRIEF DESCRIPTION OF THE DRAWINGS

FIG. 3 is an elevational view of the concrete form folded together and unassembled;

FIG. 4 is a top view of the concrete form in the process of being assembled;

FIG. 5 is a top view of the concrete form fully assembled and unfolded;

FIG. 6 is a top view of the concrete form fully assembled and folded together for shipping and storing;

FIG. 7 is a partial perspective view of the concrete forms folded flat and stored in a box; and FIG. 8 is a perspective view of the concrete form installed in place and filled with concrete.

VI. DETAILED DESCRIPTION

A collapsible cardboard concrete form is disclosed and generally designated 100. An advantage of the concrete form 100 is that the material of the form 100 is biodegradable and can be left in place to decompose. The concrete form 100 is non-toxic so that as the form 100 decomposes in place, the ground in the proximity is not contaminated. For example, the concrete form 100 may be comprised of compressed cardboard, recycled paper or other recycled material. The cardboard is used as the fiber to make the form 100 durable enough to hold back the pressure of the concrete. Compressed cardboard may be made of bio-degradable non-toxic cellulose that is bonded with glue that is also bio-degradable and non-toxic. The glue is used to bond at the corners as well as the fibers of the cardboard material of the form 100. Non-toxic glue may be used as a binder for the cardboard to prevent the fibers in the cardboard form 100 from breaking apart when exposed to moisture and before the concrete is cured. The glue may be coated or impregnated into or on the cardboard form 100.

Figure 1:
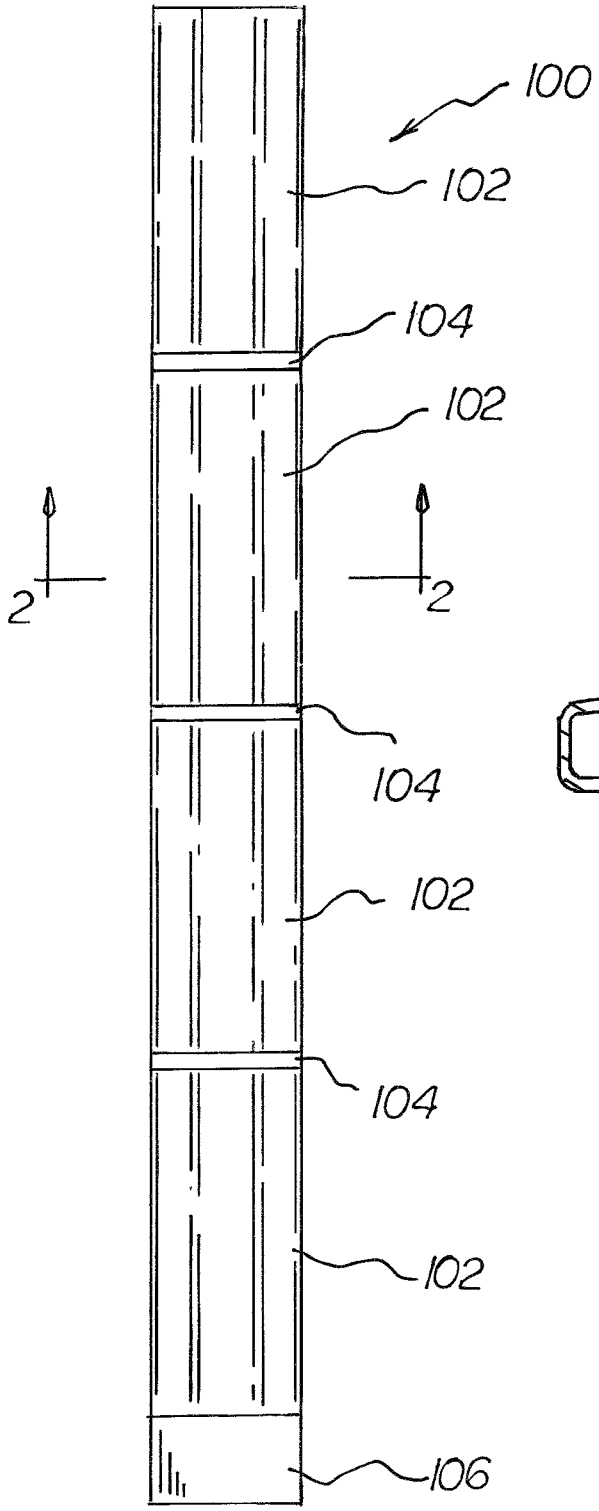
FIG. 1 is an elevational view of a particular illustrative embodiment of a collapsible cardboard concrete form.
Figure 2:
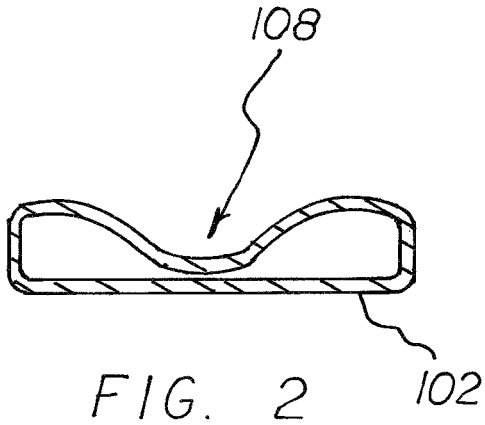
FIG. 2 is a cross sectional view of the collapsible cardboard concrete form taken along line 2-2 of FIG. 1.

Referring now to FIGS. 1 and 2, in a particular illustrative embodiment the form 100 is fabricated from a section of cardboard configured into a box beam 102 that is folded and used to create a desired shape to receive poured concrete. As shown in FIG. 1, the form 100 is laid flat. At intervals along the box beam 102, a lateral notch 104 is disposed in the outer portion of the box beam 102 and across a width of the box beam 102 to divide the box beam 102 into what will be the four sides of the form 100 when assembled. Any number of notches 104 may be used to create different shapes of the form 100 such as a triangle, hexagon or octagon, for example. In addition, the notches 104 may be equally spaced from one another or have whatever spacing is desired to create the shape of the form 100. This includes a rectangle with equal sides (i.e., a square) or with unequal sides depending on the desired shape.

The lateral notches described above 104 do not remove all the material of the form 100, rather the notches 104 include a flexible planar connector of an inner portion of the form 100 to allow the notch 104 to act as a hinge and bend to create each corner of the form 100. Otherwise, without the notches 104, the rigidity of the form 100 would not allow the form 100 to bend. In alternative embodiments, a crease or fold line may be used instead of the notch 104. At one end of the form 100, a tab 106 extends from the form 100 that is used to tuck in an opposing end of the form 100 when assembling. Other similar means may used to secure the first end and the second end of the form together.

The box beam 102 is hollow or solid, having a depressed longitudinal section 108 along the outer portion of its length for added structural integrity as best illustrated in FIG. 2. The depressed longitudinal section 108, or width, is depressed inwards towards the innter portion to create a channel on an outer side of the box beam 102. The depressed longitudinal section 108 may be continuous along the length of the box beam 102 and provides the structural strength that is needed to hold back the poured concrete. The tab 106 at one of the box beam 102 is adapted to slide in between the outer portion and the inner portion of a second end 110 of the box beam 102 to provide a snug friction fit and hold the form 100 in the desired shape. The tab 106 may also be glued or otherwise secured by physical means inside the opposing second end of the box beam 102 to prevent the form from inadvertently coming apart before the concrete is cured.

Referring now to FIG. 3, the box beam 102 is shown folded back on itself about the lateral notch 104. In this particular illustrative embodiment, two segments of the box beam 102 have been collapsed and folded back over the other two segments of the box beam 102 as shown in a top view of FIG. 3. The form 100 is in a collapsed position for storage and transport. The length of the form 100 in the collapsed position is approximately 24 inches. Accordingly, the form 100 uses little space and is relatively lightweight compared to existing forms that are typically constructed of wood boards.

In assembling the form 100 as shown in FIGS. 4 and 5, the box beam 104 is folded at the lateral notches 104 to create the corners of the form 100. In this particular illustrative embodiment, the lateral notches 104 are equally spaced to construct a square shaped void to receive the poured concrete. The first end of the box beam 102 having the tab 106 is positioned to join the opposing second end 110 of the box beam 102 to complete the square shape of the form 100 as shown in FIG. 5. As explained above, the tab 106 is one illustrative means to secure the first end and the second end 110 of the box beam 102 together. In use, the tab 106 is tucked in the opposing second end 110 of the form 110. The box beam 102 may be configured to create a rectangular, square, triangular, or any desired shape of the form 100 by varying the number and location of the lateral notches 104 (or creases). The typical size and shape of the form 100 is a 24 inch×24 inch square shape often specified in the environmental industry for well points in the field. The interior surface of the void formed by the assembled box beam 102 is continuous so that poured concrete cannot leak from the form 100.

Referring now to FIG. 6, a side view of the form 100 is shown in a collapsed position similar to that illustrated in FIG. 3. The lateral notches 104 are shown cut into the box beam 102 leaving the flexible planar connector of a lower portion of the box beam so that the notch 104 can act as a hinge and bend to create the corners of the form 100. As explained above, a crease or fold line may be used instead of the lateral notch 104. However, the lateral notch 104 is preferred as it assists in the folding of the box beam 102 back on itself and remaining flat for storage.

The ends of the form 100 have a dog-bone type cross section as the inner flat portion of the box beam 102 folds back along an opposing inner flat portion of the box beam 102 as shown in FIG. 7. This is desirable so that the outer portions of the forms 100 with the longitudinal depression 108 fit together when stacked on top of one another to be stored and shipped securely as shown in FIG. 7. The forms 100 are relatively lightweight when compared to other materials, such as wood boards, so that when the forms 100 are packed into a box 200, the box 200 containing several forms 100 can be easily carried by one person. Accordingly, several well points in a remote location can be formed up easily and quickly using the forms without having to transport relatively heavy and cumbersome materials.

The form 100 in the assembled position is shown in FIG. 8. In use, the form 100 is moved from the collapsed position to an open and assembled position to create a void that will hold poured concrete 300. The form 100 is placed on the ground, as shown in FIG. 8, and readied for concrete. As explained above, the size and shape of the form 100 is adapted to be used with environmental well points 302, or any other application where a concrete pad or foundation may be needed. For example, the form 100 may be used for planter stands, garbage can platforms, monument stands, etc.

The concrete 300 is poured within the boundary of the form 100 and allowed to cure. The form 100 is adapted to decompose in place so that the user is not required to come back and remove the form 100 at a later date. The surfaces of the form 100 may be coated with wax, or other sealant, to prevent moisture damage to the form 100 as the concrete 300 is curing. For example, bees wax may be used to protect the cardboard form 100 from water in the concrete 300 as well as ambient moisture in the ground or environment. In addition, an expandable cover may be secured to an exterior surface of the box beam 102, where the expandable cover is configured to span across an interior opening created by the box beam 102 in the assembled position to cover the concrete 300 within the form 100.

The previous description of the disclosed embodiments is provided to enable any person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined herein.

What is claimed is:

1. A collapsible concrete form, the form comprising:

a box beam comprised of cardboard, wherein the form is configured to move from a collapsed position to an assembled position to create a desired shape that will hold concrete;

a depressed longitudinal section along an outer portion of a length of the box beam;

a plurality of intermediate lateral notches disposed in the outer portion of the box beam and across a width of the box beam, wherein the intermediate lateral notches are spaced apart from each other along the box beam;

a tab extends from a first end of the box beam is configured to tuck into an opposing second end of the box beam to secure the first end and the second end of the box beam together into the desired shape; and a flexible connector of an inner portion of the box beam disposed at each intermediate lateral notch and configured to act as a hinge to create a corner of the form;

wherein the box beam is configured to be collapsible and folded flat back over itself about the intermediate lateral notches for storage and transport.

2. A collapsible concrete form, the form comprising:

a box beam having a first end and an opposing second end;

a depressed longitudinal section along an outer portion of a length of the box beam;

a plurality of intermediate lateral notches disposed in the outer portion of the box beam and across a width of the box beam; and a flexible connector of an inner portion of the box beam disposed at each intermediate lateral notch and configured to act as a hinge to create a corner of the form.

3. The form of claim 2, wherein the box beam is cardboard.

4. The form of claim 3, wherein the intermediate lateral notches are spaced apart from each other at substantially equal intervals along the box beam.

5. The form of claim 4, the box beam further comprising a tab that extends from the first end of the box beam and is configured to tuck in the opposing second end of the box beam to secure the first end and the second end of the box beam together into a rectangular shape.

6. The form of claim 5, wherein the box beam is configured to be collapsible and folded flat back over itself about the intermediate lateral notches for storage and transport.

7. The form of claim 6, wherein the depressed longitudinal section is configured to provide structural support to the box beam.

8. The form of claim 7, wherein the form is configured to move from a collapsed position to an assembled position to create the rectangular shape that will hold concrete within its sides.

9. The form of claim 8, wherein the form is configured to be placed on the ground so that the concrete is contained within a boundary of the form and allowed to cure.

10. The form of claim 9, wherein the form is configured to decompose in place.

11. The form of claim 10, wherein exposed surfaces of the form are coated with wax, sealant, or any combination thereof, to prevent moisture damage to the form as the concrete is curing.

12. A collapsible concrete form, the form comprising:

a box beam having a first end and an opposing second end configured to secure together to define a desired continuous shape of a void to receive concrete therein; and a plurality of flexible lateral connectors intermediately disposed along the box beam and configured to act as a hinge about which to fold the box beam from a collapsed position to an assembled position.

13. The collapsible concrete form of claim 12, wherein the beam is configured to join a second beam in end-to-end succession to form the void to receive the concrete.

14. The collapsible concrete form of claim 13, wherein the beam is comprised of cardboard.

15. The collapsible concrete form of claim 14, wherein the beam is configured to be collapsible and folded flat back over itself about the plurality of flexible connectors.

16. The collapsible concrete form of claim 15, wherein beam is a box beam having a depressed longitudinal section configured to provide structural support to the beam.

* * * * *